United States Patent [19]

Conrad

[11] Patent Number: 4,733,427

[45] Date of Patent: Mar. 29, 1988

[54] UNDERWATER BRUSH

[76] Inventor: Richard H. Conrad, 950 Idylberry Rd., San Rafael, Calif.

[21] Appl. No.: 872,531

[22] Filed: Jun. 10, 1986

[51] Int. Cl.[4] ..... A46B 15/00; E04H 3/20

[52] U.S. Cl. ..... 15/160; 15/1.7

[58] Field of Search ..... 15/1.7, 160; 114/222

[56] References Cited

U.S. PATENT DOCUMENTS 3,010,420 11/1961 Glynn ..... 114/222

FOREIGN PATENT DOCUMENTS 584029 1/1947 United Kingdom ..... 15/1.7

*Primary Examiner*—Peter Feldman

*Attorney, Agent, or Firm*—Larry D. Johnson

[57] ABSTRACT

The present invention provides an improved brush for cleaning underwater surfaces, such as swimming pool walls and bottoms, and uses a hinged wing that presents an inclined plane to the water when the brush is moved in its downward stroke. The wing thus acts to exert a desired force upon the brush which urges the brush against the surface being cleaned. On the return stroke of the brush, the hinged wing is caused to move to a position trailing the brush, where it avoids urging the brush back into contact with the surface that was just cleaned on the downward stroke. Rather, this trailing position helps to keep the brush off of the cleaned surface, and creates little or no drag for the return stroke.

4 Claims, 3 Drawing Figures

UNDERWATER BRUSH

BACKGROUND OF THE INVENTION

1. Field of the Invention

This invention relates generally to brushes and cleaning devices, and more specifically to an improved brush for the cleaning of underwater surfaces, such as swimming pools.

2. Description of the Prior Art

Underwater surfaces, such as the sides and bottoms of swimming pools and boat hulls, tend to accumulate dirt, debris, mineral deposits, and plant or animal growth. Accordingly, it is often important to clean these surfaces, to remove such accumulations and prevent their further buildup.

Numerous brushes and other cleaning devices have been developed to accomplish this task. The most common are simply bristled brushes equipped with extra-long pole handles for reaching the desired area. As a consequence of the geometry involved, cleaning surfaces such as the walls and bottom of swimming pools with these brushes requires extraordinary effort on the part of the user, who is at a great mechanical disadvantage and must exert considerable force on the long pole in a direction perpendicular to the surface to be cleaned, while simultaneously applying the force required for the back-and-forth cleaning movement.

Other cleaning devices have incorporated variations on a structurally inclined "wing" that exerts a force on the brush as it is moved through the water, thus causing the brush to scour the surface to be cleaned more effectively. However, while a brush equipped with a fixed wing can operate well in one direction, for example the downward stroke, on the return stroke it swings uncontrollably outward or upward, creating a large amount of drag and making the return stroke very difficult for the user. Variations on the fixed-wing concept have included devices with shaped wings, for example a ladle-like configuration, which decreases the drag produced on the return stroke. However, this still results in considerable drag in both directions, and difficulty in moving the brush from side to side.

Still other brushes have used pivotable wings which flip over at the end of the downward stroke to present a similarly inclined surface to the water on the return stroke. However, this feature makes such brushes less desirable for pool cleaning, where the purpose is to scour the debris and move it downward toward the drain only, and not move the debris back upward on the return stroke. In addition, this arrangement requires the user to exert a pulling force on the return stroke similar in magnitude to the pushing force required on the downstroke. Such pulling effort can be awkward and tiresome to the user, and also has the unfortunate tendency to pull the user into the water.

SUMMARY OF THE INVENTION

The present invention provides an improved brush for cleaning underwater surfaces, such as swimming pool walls and bottoms, and uses a hinged wing that presents an inclined plane to the water when the brush is moved in its downward stroke. The wing thus acts to exert a desired force upon the brush which urges the brush against the surface being cleaned. On the return stroke of the brush, the hinged wing is caused to move to a position trailing the brush, where it avoids urging the brush back into contact with the surface that was just cleaned on the downward stroke. Rather, this trailing position helps to keep the brush off of the cleaned surface, and creates little or no drag for the return stroke.

Thus the present invention provides a highly practical brush device which requires a working force only on the downward or pushing stroke, as preferred, and completely eliminates any necessity for the manual application of a perpendicular force to achieve cleaning. In addition, the device yields a nearly effortless return (non-working) stroke, while keeping the brush away from the cleaned surface, with no tendency of the brush to go off at any angle except straight back to the user. The arrangement thus lends itself to a continuous, rhythmic brushing cycle, with easy directional reversals and low-drag sideways maneuvering for successive strokes.

The improved brush device of this invention can take the form of a complete wing/brush or wing/brush/pole unit. Alternatively, the invention can take the form of the wing assembly alone, for easy attachment to existing pool brushes.

In a particular embodiment of the present invention, the wing consists of a flat, roughly rectangular piece of plastic that is attached by hinges along one of its edges to the long axis of the top side of an otherwise typical pool brush. A buoyancy piece, made of a hollow float, foam or other buoyant material, is mounted on the middle surface of the wing facing the brush handle, so that when the wing is pivoted towards the handle, the buoyancy piece acts as a stop mechanism to support and maintain the wing at a desired angle to the brush and handle.

An explanation of a typical cleaning cycle using the present invention is as follows: The improved brush is placed into the water, with its cleaning bristles oriented generally towards the side of the pool to be cleaned. Even before the initiation of the downward cleaning stroke, the slightly buoyant characteristic of the buoyancy piece acts to keep the wing generally above the brush, so that when the brush begins its downward stroke, the wing is already near its operating position. Upon the first movement of the downward stroke, the wing is moved by the force of the water back towards the handle until the buoyancy piece/stop mechanism contacts the handle. At this point, when the wing cannot move further back, the force of the water against the wing is directed against the handle and brush, thereby increasing the brush's frictional contact with the pool's surface, and greatly improving the cleaning effect. As the brush is moved downwards, loosened debris is moved ahead of it in the direction of the bottom of the pool and the pool drain.

At the end of the downward stroke, when the brush is briefly motionless, the slight buoyancy of the buoyancy piece again causes the wing to orient above the brush. When the return stroke begins, the wing is again moved by the force of the water, but now it is allowed to freely move completely back to be coplanar with and trailing the brush and pole. Thus the buoyancy piece assists both in orienting the wing for the initial stroke, and, during slow brushing, in pivoting the wing in the transitions between strokes.

A further advantage of a generally flat wing is that such a configuration does not present a large horizontal cross-section, enabling the brush device to be easily moved laterally through the water. This feature is important to the user because repeated, progressively side-by-side strokes are necessary to clean a typical pool. Additionally, the streamlined wing provides a low-drag conversion of longitudinal force into perpendicular force on the downward stroke, and on the return stroke acts as a hydrodynamic "splitter plate" which supresses drag-producing vortices and thus reduces the drag created by the brush itself.

DETAILED DESCRIPTION OF A PREFERRED EMBODIMENT

Figure 1:
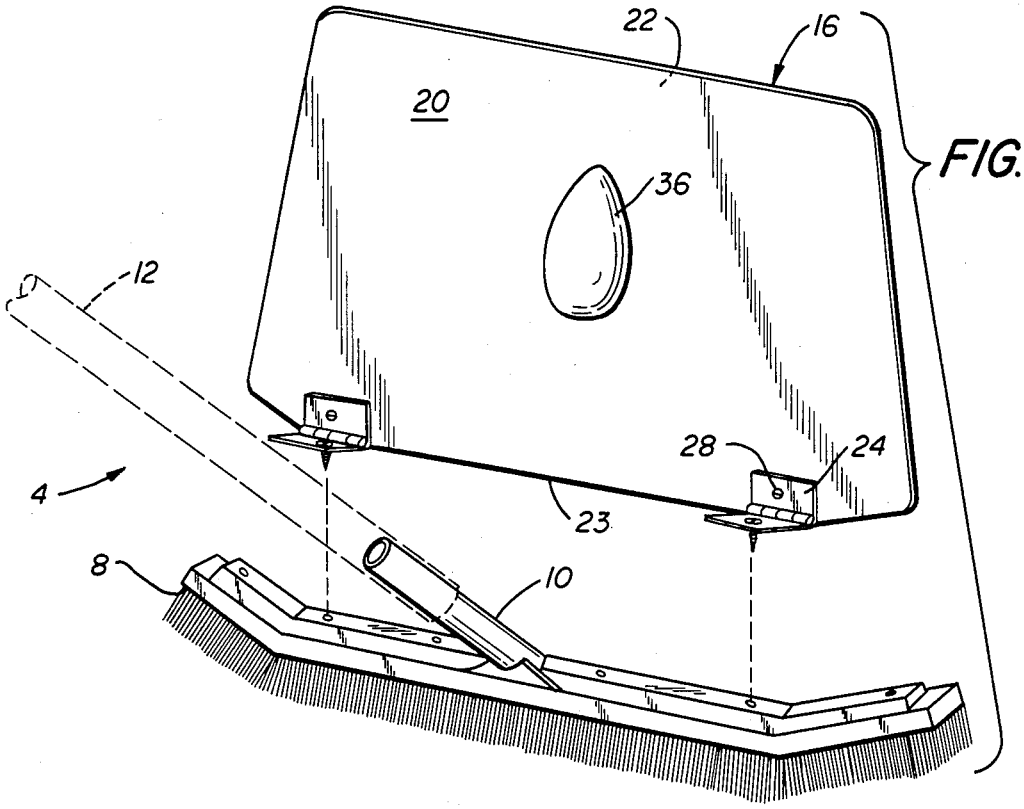
FIG. 1 is a perspective view of the underwater brush device of this invention, utilizing a typical swimming pool brush and handle.

FIG. 1 illustrates an underwater brush device 4 of this invention in perspective view. The device 4 includes a standard bristled pool brush 8 including a handle stub 10 for attachment to an elongate pole or handle 12 (illustrated in phantom). Handle 12 may be of any desired length, and it may be an integral part of the handle stub 10 so as to form a single piece. A substantially flat vane or wing 16, having an inner surface 20 and an outer surface 22, is pivotally connected at an edge 23 to the top of brush 8 by means of hinges 24 and screws 28. Wing 16 is preferably made of a lightweight, rigid, and non-corroding material such as plastic.

Extending from the surface 20 of the wing is a buoyancy piece/stop mechanism 36, which faces toward and generally aligns with the handle 12. Bouyancy piece 36 is preferably made of foam or other buoyant material, and is shaped to minimize drag when moving through the water.

Figure 2:
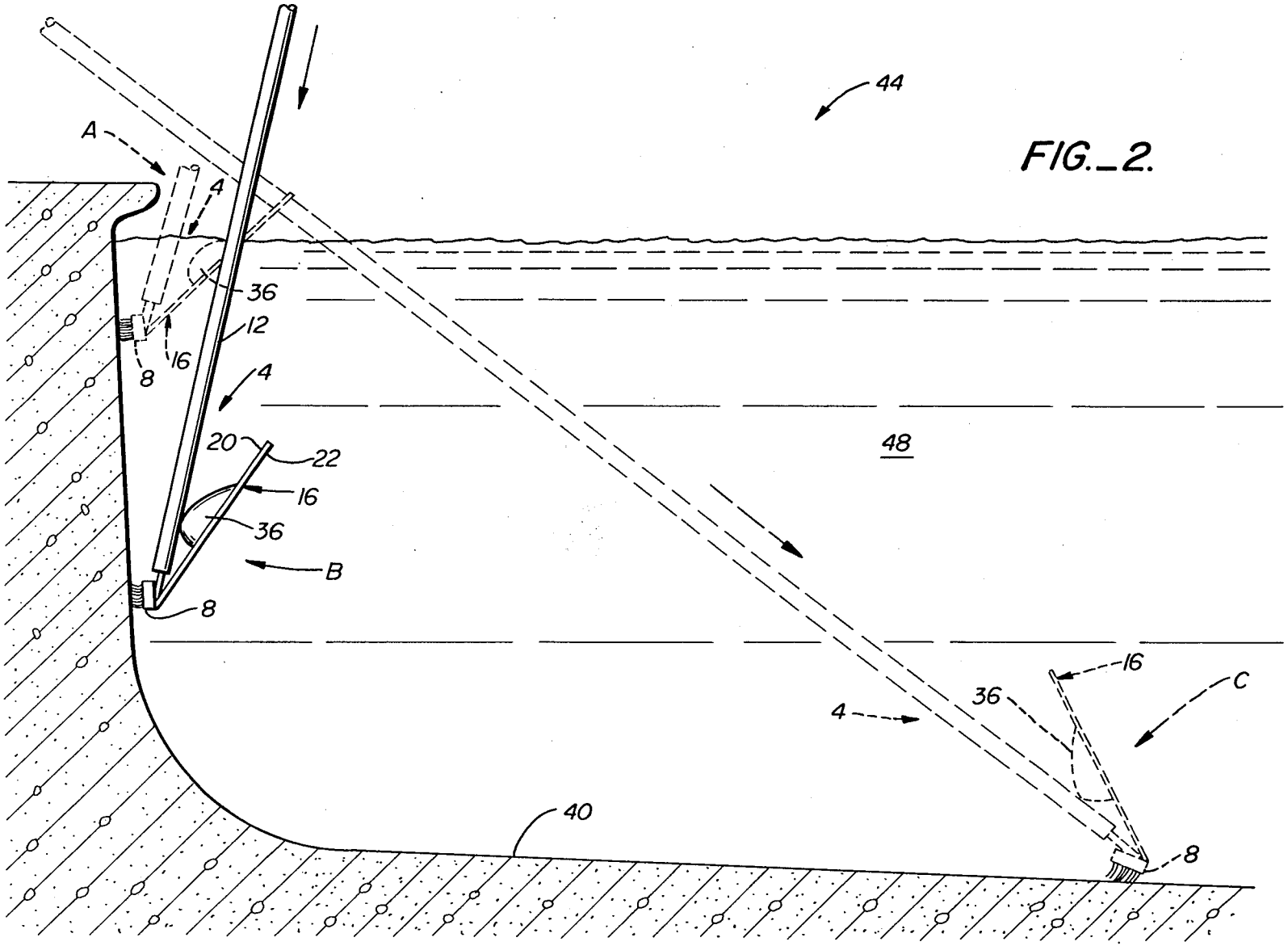
FIG. 2 is an elevated side view of the underwater brush device of this invention, in operation during a downward (working) stroke.

Referring now to FIG. 2 with greater particularity, the underwater brush device is shown in elevated side view in operation during a downward (cleaning) stroke. In this view, device 4 is shown in several positions of cleaning a surface 40 of a swimming pool 44 containing water 48. When device 4 is initially placed into the water (as illustrated in phantom as position "A" of FIG. 2), the buoyancy piece 36 acts to keep the wing 16 generally above the brush 8, so that the wing is already near its operating position.

During the actual downstroke, as illustrated by position "B" of FIG. 2, the inertial force exerted by the water on the outer surface 22 of wing 16 has caused the wing to fold back towards handle 12 until buoyancy piece/stop mechanism 36 contacts handle 12, setting the wing at an optimal angle and preventing further movement of the wing in that direction. While the stop mechanism can be sized to effect nearly any angle for the wing, it has been found that the resultant angle should be in the range of 15 to 30 degrees (with respect to the pole handle) for for greatest efficiency. In that orientation, movement of the device 4 through the water transfers a component of the water's inertial force exerted on wing 16 to the brush 8 and presses said brush against surface 40 of the pool, thereby greatly improving the brush's cleaning action. This orientation, and the resultant cleaning action, continues throughout the downstroke, as illustrated in position "C" of FIG. 2.

Figure 3:
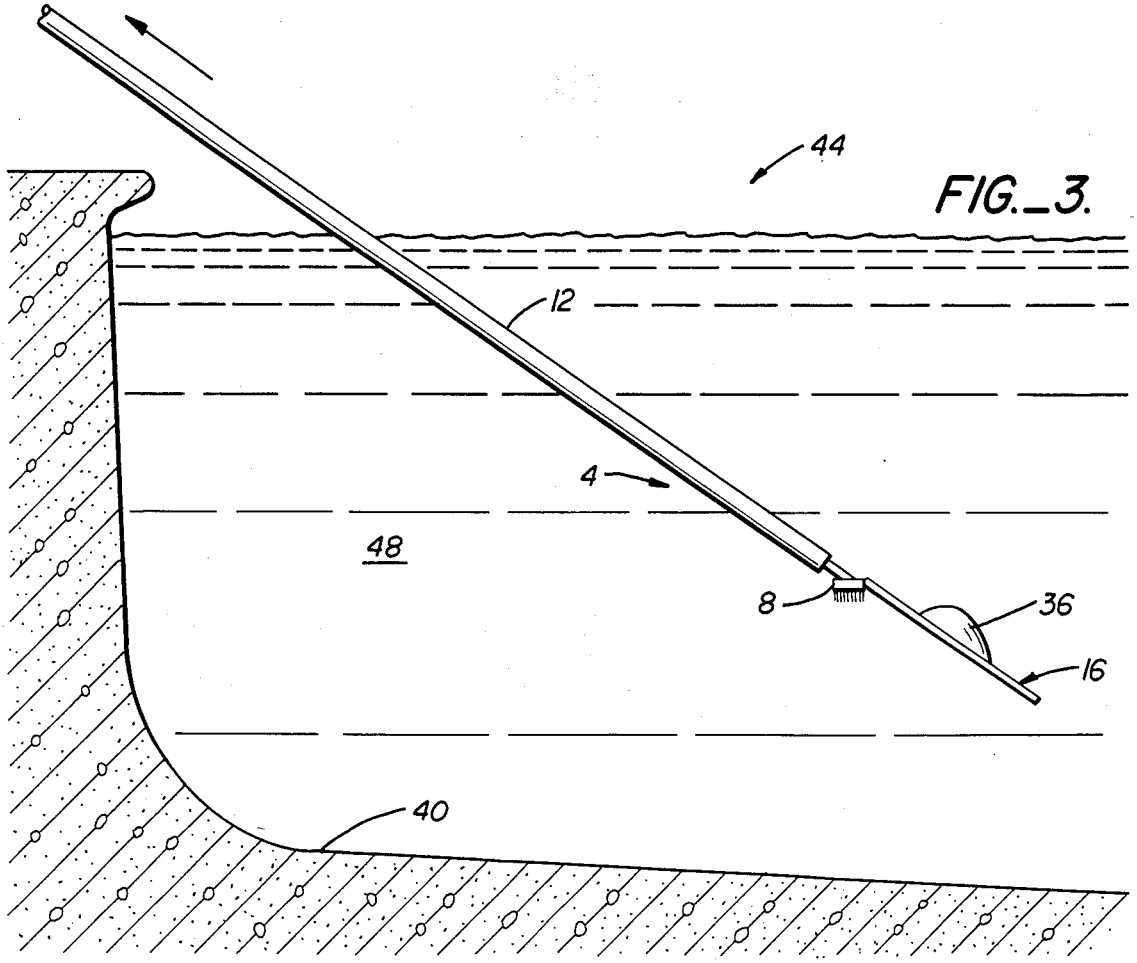
FIG. 3 is an elevated side view of the underwater brush device of this invention, in operation during a return (non-working) stroke.

Referring now to FIG. 3 with greater particularity, the underwater brush device is shown in operation during its return (non-working) stroke. In this direction, wing 16 is freely trailing the brush and handle, avoiding force on the brush, and allowing the assembly to return to the user without further contact of the pool surface 40, and without any tendency to move in any direction except straight back towards the user. In addition, in this orientation the wing's streamlined cross-section tends to reduce the drag of the brush itself, thereby requiring less effort on the part of the user.

While this invention has been described in connection with preferred embodiments thereof, it is obvious that modifications and changes therein may be made by those skilled in the art to which it pertains without departing from the spirit and scope of the invention. For example, the wing could be attached directly to the handle rather than to the brush itself. Also, the wing could be shaped in a variety of ways without significantly affecting the benefits of the device. Accordingly, the scope of this invention is to be limited only by the appended claims.

What is claimed as invention is:

1. An underwater brush device comprising:

a brush including a handle for cleaning an underwater surface; and a pivotable wing means attached to said brush for exerting a force on said brush in the direction of said surface to be cleaned when said brush is moved through the water in a first direction, and pivoting to exert no such force and not urge said brush in any direction when said brush is moved in the opposite direction, a stop means for preventing further wing pivot, so that when said brush is moved in said first direction, said wing means pivots until prevented from further pivoting by said stop means, and buoyancy means, so that when said brush is generally stationary in the water, said buoyancy means acts to orient said wing generally above said brush.

2. The underwater brush device of claim 1 wherein said stop means and said buoyancy means comprise a buoyant piece of material attached to said pivotable wing.

3. The underwater brush device of claim 2 wherein said pivotable wing is attached to and pivots about said brush by a hinge means.

4. A brush attachment comprising:

a pivotable wing member conditioned to attach to a brush by hinge means so that when said brush is moved through a fluid in a first direction, said wing reacts to such movement by pivoting to a position in which it urges said brush in a direction generally perpendicular to said first direction, and when said brush is moved through the fluid in the direction opposite said first direction, said wing reacts to such movement by pivoting to trail behind said brush, and not urge it in any direction, wherein a stop mechanism is included to limit the pivoting of said wing when said brush is moved through the fluid in the first direction, and including buoyancy means, so that when said brush is generally stationary in the water, said buoyancy means acts to orient said wing generally above said brush.

* * * * *